US009845614B2

(12) United States Patent
Huang

(10) Patent No.: US 9,845,614 B2
(45) Date of Patent: Dec. 19, 2017

(54) AWNING MOUNTING RACK, THE AWNING AND AN AWNING TOP OF THE AWNING MOUNTING RACK

(71) Applicant: XIAMEN ROADZUP OUTDOOR PRODUCTS CO., LTD., Xiamen, Fujian (CN)

(72) Inventor: Changjiu Huang, Xiamen (CN)

(73) Assignee: XIAMEN ROADZUP OUTDOOR PRODUCTS CO., LTD., Xiamen (CN)

( * ) Notice: Subject to any disclaimer, the term of this patent is extended or adjusted under 35 U.S.C. 154(b) by 33 days.

(21) Appl. No.: 14/799,019

(22) Filed: Jul. 14, 2015

(65) Prior Publication Data

US 2016/0160523 A1 Jun. 9, 2016

(30) Foreign Application Priority Data

Jun. 6, 2014 (CN) ..... 2014 1 0249583

(51) Int. Cl.

| | |
|---|---|
| ***E04H 15/50*** | (2006.01) |
| ***E04H 15/46*** | (2006.01) |
| ***E04H 15/52*** | (2006.01) |
| *E04H 15/18* | (2006.01) |

(52) U.S. Cl.

CPC ..... *E04H 15/50* (2013.01); *E04H 15/46* (2013.01); *E04H 15/52* (2013.01); *E04H 15/18* (2013.01)

(58) Field of Classification Search

CPC ..... E04H 15/44; E04H 15/46; E04H 15/48; E04H 15/50

See application file for complete search history.

(56) References Cited

U.S. PATENT DOCUMENTS

| | | | | |
|---|---|---|---|---|
| 2,135,961 | A * | 11/1938 | Chenoweth | E04H 15/00 135/143 |
| 2,723,673 | A * | 11/1955 | Call | E04H 15/46 135/140 |
| 6,283,136 | B1 * | 9/2001 | Chen | E04H 15/48 135/130 |
| 7,360,549 | B2 * | 4/2008 | Seo | E04H 15/44 135/145 |
| 7,836,908 | B2 * | 11/2010 | Sy-Facunda | E04H 15/50 135/122 |

(Continued)

FOREIGN PATENT DOCUMENTS

| | | | | |
|---|---|---|---|---|
| JP | 2007132097 A | * | 5/2007 | |
| WO | WO 2012092854 A1 | * | 7/2012 | E04H 15/50 |

*Primary Examiner* — David R Dunn
*Assistant Examiner* — Danielle Jackson
(74) *Attorney, Agent, or Firm* — Rabin & Berdo, P.C.

(57) ABSTRACT

An awning mounting rack includes four stand columns; a first folding bracket is disposed between two adjacent stand columns; each stand column has a top holder. The top holder includes a first pole, a second pole and a support pole. The four stand columns include two first stand columns and two second stand columns; the other ends of the second poles connected to the first stand columns are pivot joined to the first top set, the non-end portions of the second poles connected to the first stand columns are respectively pivot joined to a first support rod, the ends of the first support rods are pivot joined to a first bottom set; the other end of the second poles connected to the second stand column are pivot joined to a second top set, the non-end portions of the second poles are pivot joined to a second support rod.

13 Claims, 11 Drawing Sheets

(56) References Cited

U.S. PATENT DOCUMENTS

| | | | | |
|---|---|---|---|---|
| 2006/0174928 | A1* | 8/2006 | Choi | E04H 15/58<br>135/145 |
| 2015/0090309 | A1* | 4/2015 | Ma | E04H 15/50<br>135/122 |

* cited by examiner

AWNING MOUNTING RACK, THE AWNING AND AN AWNING TOP OF THE AWNING MOUNTING RACK

FIELD OF THE INVENTION

The present invention relates an awning mounting rack, the awning and an awning top of the awning mounting rack.

BACKGROUND OF THE INVENTION

Existing known awning mounting rack, referring to FIG. 1, comprises four stand columns 10', the top end of each stand column 10' is disposed with a fixation set 11' fixedly, each stand column 10' is slidably disposed with a slide set 12'; a first folding bracket 20' is pivoted and disposed between the fixation sets 11' and the slide sets 12' of two adjacent stand columns 10'; each stand column 10' is connected to a top holder 30', the top holder 30' comprises a first pole 31', a second pole 32' and a support pole 33', one end of the first pole 31' is rotatably connected to one end of the second pole 32', the other end of the first pole 31' is pivot joint to the fixation set 11', both ends of the support pole 33' are respectively pivot joint to the slide set 12' and a non-end portion of the first pole 31'; the other ends of the second poles 32' are pivot joint to a top set 40'. This kind of awing mounting rack has only one top point, so that it has some problems: 1. the internal space is small; 2. the packing size is large due to the folding length of the first pole and the second pole; 3. the strength and the stability of the awning mounting rack are needed to be improved.

SUMMARY OF THE INVENTION

The present invention provides an awning mounting rack, the awning and an awning top of the awning mounting rack to solve the disadvantages of the existing known problems.

A technical proposal of the prevent invention is that:

An awning mounting rack, comprising four stand columns (10), the top end of each stand column (10) is configured fixedly with a fixation set (11), each stand column (10) is slidably connected with a slide set (12); a first folding bracket (20) is pivoted and disposed between the fixation sets (11) and the slide sets (12) of two adjacent stand columns (10); each stand column (10) is connected to a top holder (30), the top holder (30) comprises a first pole (31), a second pole (32) and a support pole (33), one end of the first pole (31) is rotatably connected to one end of the second pole (32), the other end of the first pole (31) is pivot joint to the fixation set (11), both ends of the support pole (33) are respectively pivot joint to the slide set (12) and a non-end portion of the first pole (31); wherein the four stand columns (10) comprises two first stand columns and two second stand columns; the other ends of the second poles (32) connected to the first stand columns (10) are pivot joint to the a first top set (41), the non-end portions of the second poles (32) connected to the first stand columns (10) are respectively pivot joint to a first support rod (42), the ends of the first support rods (42) are pivot joint to a first bottom set (43); the other end of the second poles (32) connected to the second stand column (10) are pivot joint to a second top set (44), the non-end portions of the second poles (32) connected to the second stand columns (10) are respectively pivot joint to a second support rod (45), the ends of the second stand rods (45) are pivot joint to a second bottom set (46), the first top set (41), the first bottom set (43), the second top set (44) and the second bottom set (46) are pivot joint to a second folding bracket.

In another preferred embodiment, the first folding bracket (20) comprises two scissor type first linkworks (21) that are series connected in pivot way, the second folding bracket comprises a scissor type second linkwork (47), a lock device is disposed between the slide set (12) and the stand column (10) for locking and unlocking.

In another preferred embodiment, the first folding mounting bracket (20) comprises two scissor type first linkworks (21) that are series connected in pivot way, the second folding bracket comprises two scissor type second linkworks (47) that are series connected in pivot way, a lock device is disposed between the slide set (12) and the stand column (10) for locking and unlocking.

In another preferred embodiment, the number of the stand columns (10) is an even number, the first stand columns have same number with the second stand columns, the first stand columns and the second stand columns are coaxially and symmetrically arranged.

In another preferred embodiment, it further comprises a first reinforcing bracket (50) that comprises a first reinforcing pole (51), a second reinforcing pole (52) and a first driving pole (53); the two first linkworks (21) of the first folding bracket (20) are serious connected in pivot way and comprise an upper pivot position and a lower pivot position; one end of the first reinforcing pole (51) is rotatably connected to one end of the second reinforcing pole (52), the other end of the first reinforcing pole (51) is pivot joint to the first top set (41), the other end of the second reinforcing pole (52) is pivot joint to the upper pivot position, both ends of the first driving pole (53) are respectively pivot to the first bottom set (43) and the non-end portion of the first reinforcing pole (51).

In another preferred embodiment, a first reinforcing bracket (50) is pivot joint to the second top set (44), the second bottom set (46) and the upper pivot position of the first folding bracket (20) that is faced to another first folding bracket (20) that is connected to the first reinforcing bracket (50).

In another preferred embodiment, it further comprises a second reinforcing bracket (60) that comprises a third reinforcing pole (61), a fourth reinforcing pole (62) and a second driving pole (63); the two first linkworks (21) of the first folding bracket (20) are serious connected in pivot way and comprise a first upper pivot position and a first lower pivot position; the two second linkworks (47) of the second folding bracket are serious connected in pivot way and comprise a second upper pivot position and a second lower pivot position; one end of the third reinforcing pole (61) is rotatably connected to one end of the fourth reinforcing pole (62), the other end of the second reinforcing pole (61) is pivot joint to the second upper pivot position, the other end of the fourth reinforcing pole (62) is pivot joint to the first upper pivot position, both ends of the second driving pole (63) are respectively pivot to the second lower pivot position and the non-end portion of the third reinforcing pole (61).

A second technical proposal of the prevent invention is that:

An awning comprising the awning mounting rack, further comprising an awning clothe, the awning cloth is connected at the top side of the second folding bracket and the top holder (30).

A third technical proposal of the prevent invention is that:

An awning top of an awning mounting rack, comprising four top supports, the top support comprises a first pole, a second pole and a support pole, one end of the first pole is rotatably connected to one end of the second pole, one end of the support rod is pivot joint to the non-end portion of the first pole; wherein the four top supports (30) comprises two first top supports and two second top supports; the other end of the second pole (32) of the first top support (30) is pivot joint to a first top set (41), the non-end portion of the second pole (32) of the first top support (30) is pivot joint to a first support rod (42), the ends of the first support rods (42) are pivot joint to a first bottom set (43); the other end of the second pole (32) of the second top support is pivot joint to a second top set (44), the non-end portion of the second pole (32) of the second top support is pivot joint to a second support rod (45), the ends of the second support rods (45) are pivot joint to a second bottom set (46); the first top set (41), the first bottom set (43), the second top set (44) and the second bottom set (46) are pivot joint to a second folding bracket.

Compared to the existing known technology, the technical proposal of the present invention has advantages as follows:

With the two top sets, two bottom sets and the second folding bracket to form a double-roof structure, it forms a cross-line top after connected with an awning cloth, the internal space is large enough, and it has following technical effects: 1. with the second folding bracket, the first pole, the second pole, the top holder, the first folding bracket, the whole awning mounting rack is capable of folding and unfolding, the folding and unfolding are convenient and fast, so that the whole awning mounting rack is integrated, thus improving its wind resistance performance; the double-roof structure can reduce the length of the first pole and the second pole, it also reduces the folding length of the top support, thus reducing the packing size of the whole awning.

The present invention further comprises a first reinforcing bracket and a second reinforcing bracket, it improves the wind resistance performance of the side frame, thus reinforcing the strength of the whole frame, the present invention can be folded and unfolded integrally.

BRIEF DESCRIPTION OF THE DRAWINGS

The present invention will be further described with the drawings and the embodiments.

DETAILED DESCRIPTION OF THE EMBODIMENTS

The First Embodiment

Figure 1:
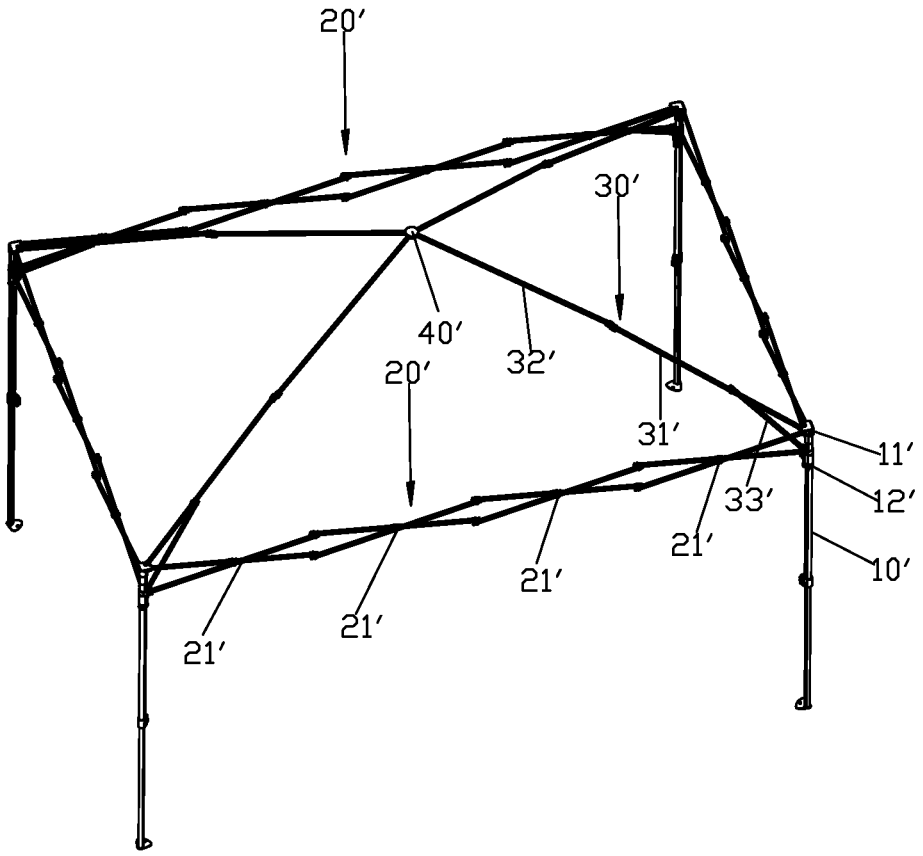
FIG. 1 (PRIOR ART)
FIG. 1 illustrates a schematic diagram of an existing known awning mounting rack.
Figure 2:
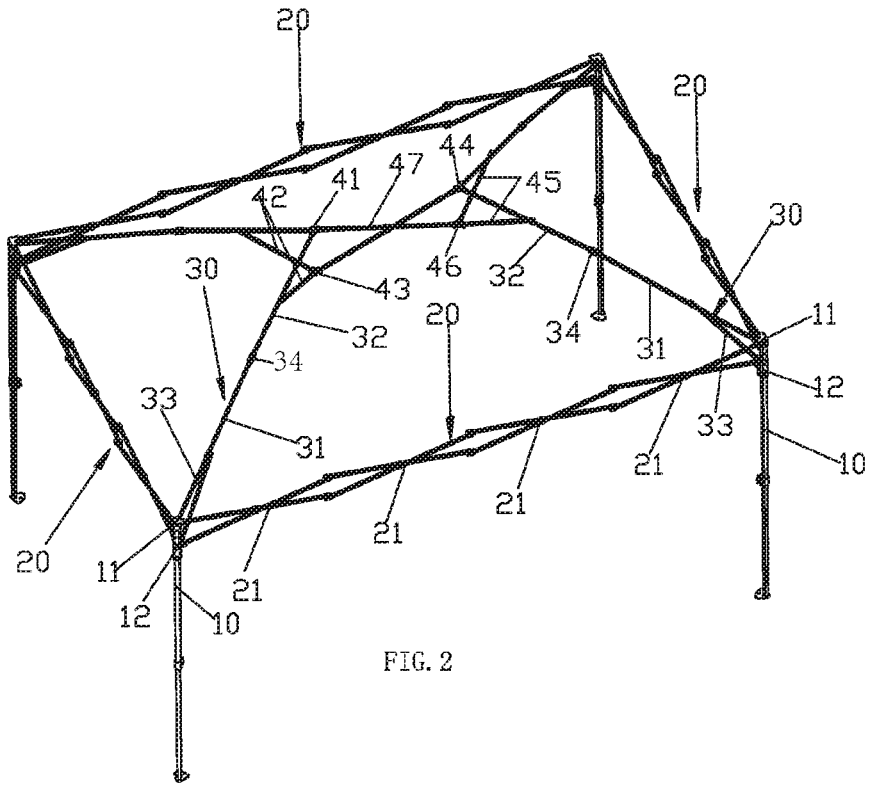
FIG. 2 illustrates a schematic diagram of an awning mounting rack of a first embodiment in unfolding state.
Figure 3:
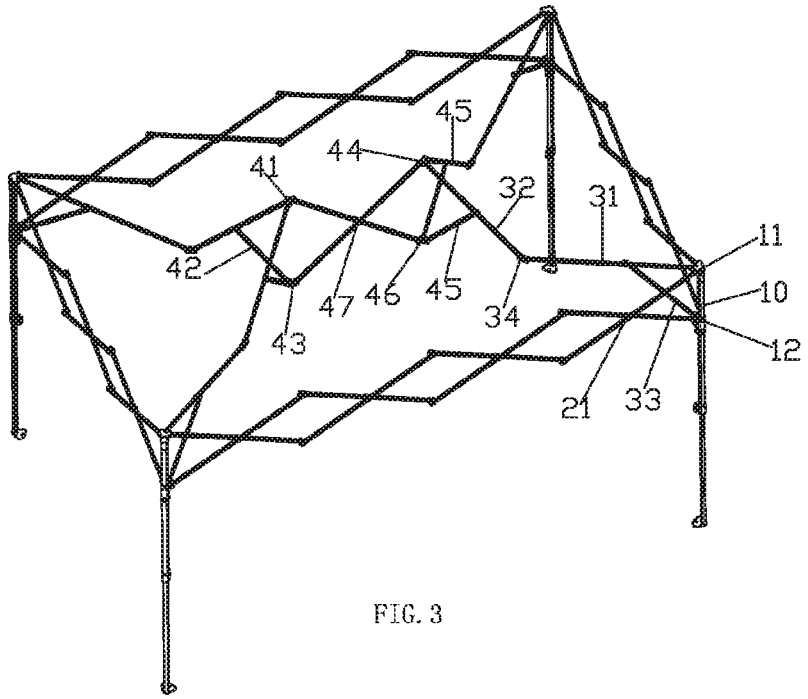
FIG. 3 illustrates a schematic diagram of the awning mounting rack of the first embodiment in semi-folding state.
Figure 4:
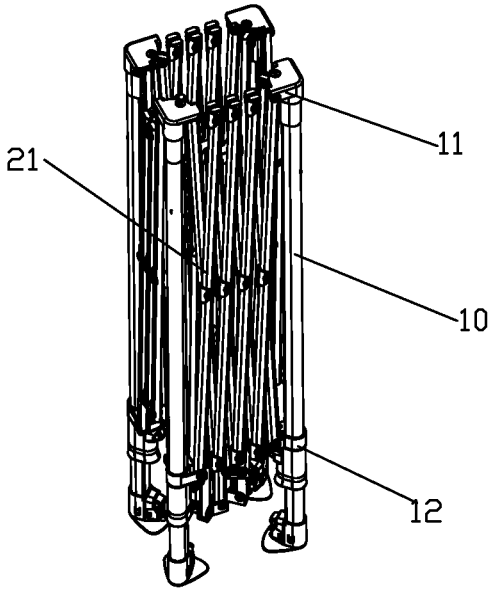
FIG. 4 illustrates a schematic diagram of the awning mounting rack of the first embodiment in folding state.
Figure 5:
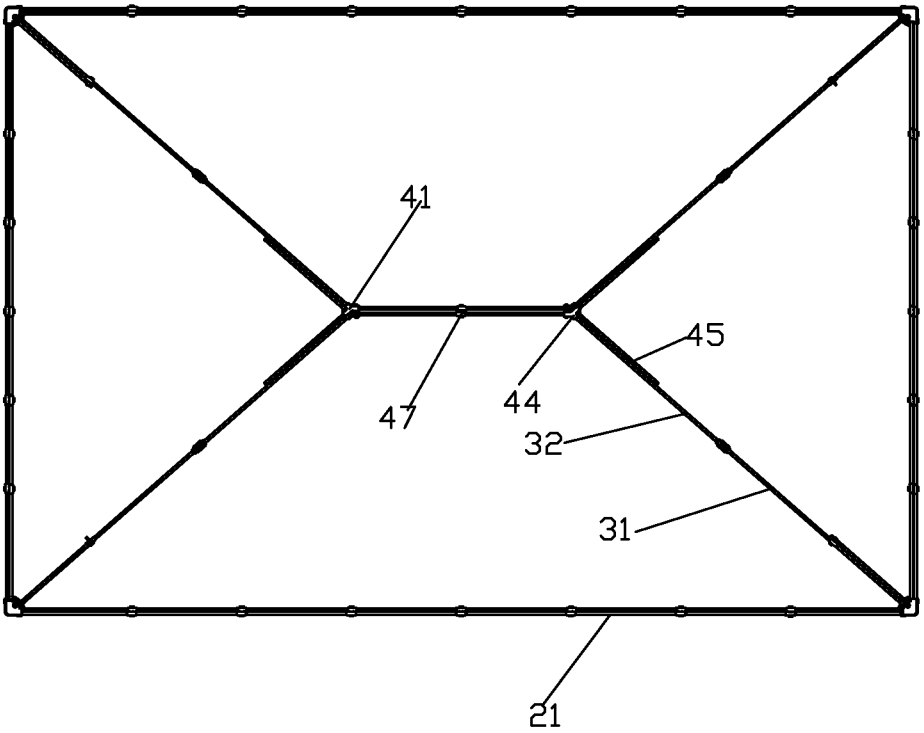
FIG. 5 illustrates a top view of the awning mounting rack of the first embodiment in unfolding state.
Figure 6:
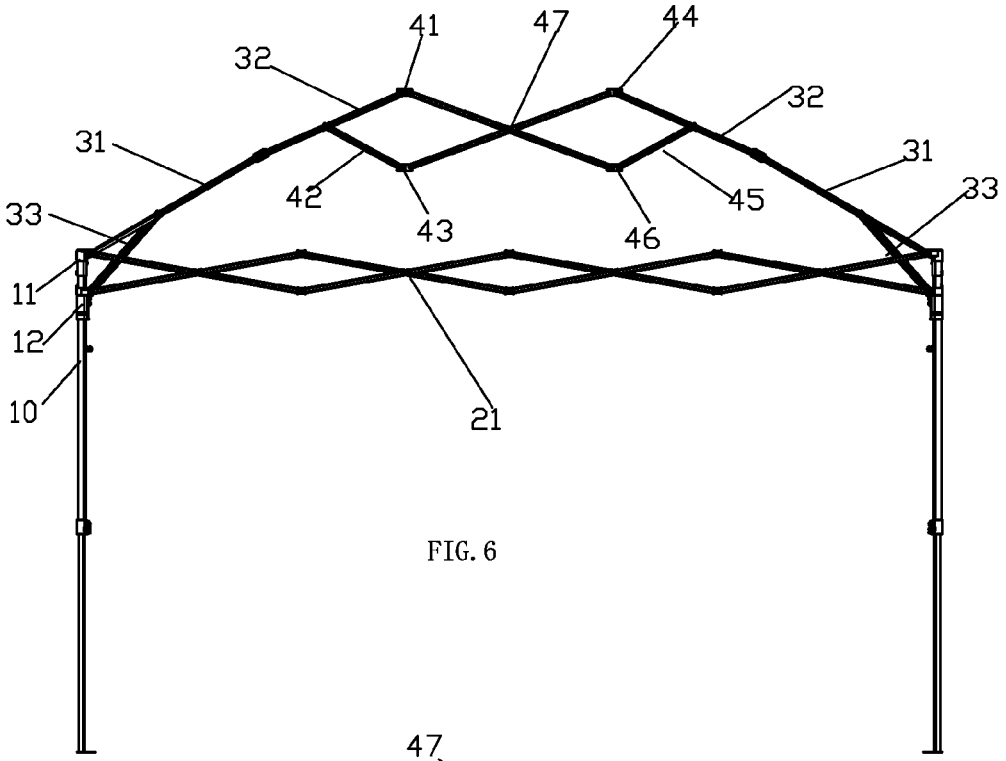
FIG. 6 illustrates a front view of the awning mounting rack of the first embodiment in unfolding state.
Figure 7:
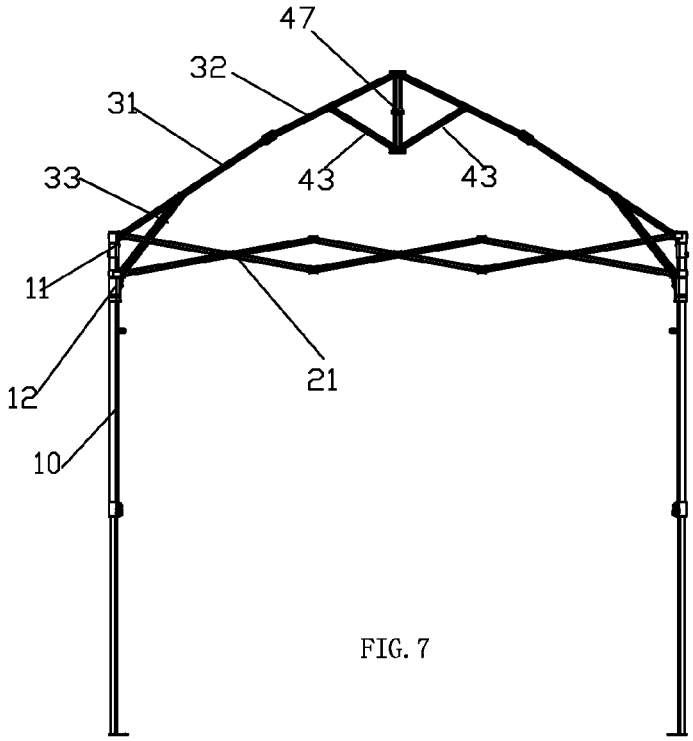
FIG. 7 illustrates a left side view of the awning mounting rack of the first embodiment in unfolding state.

An awning mounting rack, referring to FIGS. 1-7, comprising four stand columns 10, the top end of each stand column 10 is disposed with a fixation set 11 fixedly, each stand column 10 is slidably disposed with a slide set 12; a lock device is disposed between the slide set 12 and the stand column 10 for locking and unlocking, when the lock device is released, the slide set 12 can be adjusted up and down with respect to the stand column 10, when the lock device is locked, the slide set is fixed with respect to the stand column 10. in this embodiment, the number of the stand columns 10 is preferred an even number, for example four, six, eight, etc, this embodiment takes four stand columns 10 for example.

These four stand columns 10 can be unfolded from the center to the outer side thus being far away respectively to each other, and they can be folded to the center thus being approach to each other, when in unfolding state, these stand columns are annularly and spaced arranged to be a quadrangle annular structure, a hexagon annular structure, an octagon annular structure, etc, a first folding bracket 20 is pivoted and disposed between the fixation sets 11 and the slide sets 12 of two adjacent stand columns 10. the first folding bracket 20 comprises two scissor type first linkworks 21 that are series connected in pivot way. The scissor type first linkwork 21 comprises two link rods, the centers of the two link rods are pivot joint together to form the scissor type structure; series connecting means that the two first linkworks 21 are series arranged, and in two adjacent first linkworks 21: the upper end of one first linkwork 21 is rotatably connected to the upper end of the other first linkwork 21, the lower end of one first linkwork 21 is rotatably connected to the lower end of the other first linkwork 21, with the connection, when the slide set slides with respect to the stand column, the first linkworks can fold and unfold, the first folding bracket has four outer ends, the four outer ends are respectively pivot joint to the fixation sets 11 and the slide sets 12 of two adjacent stand columns 10. in this embodiment, the number of the first linkworks of the first folding bracket of two adjacent stand columns can be the same or different, it can be square or rectangular from the top view.

Each stand column is connected to a top holder 30 that comprises a first pole 31, a second pole 32 and a support pole 33, one end of the first pole 31 is rotatably connected to one end of the second pole 32, the other end of the first pole 31 is pivot joint to the fixation set 11, both ends of the support pole 33 are respectively pivot joint to the slide set 12 and the non-end portion of the first pole 31. The non-end portion means the portion not at the end portion, as needed, it can be a position at the center or a position at the ¼-¾ of the length, following mentioned non-end portions are the same description as this embodiment. One end of the first pole 31 is rotatably connected to one end of the second pole 32, as needed, they can be pivoted directly or pivoted by a pivot set, the pivot set comprises a U shaped set 34 having an opening, one end of the first pole 31 and one end of the second pole 32 are disposed in the U shaped set 34 and are respectively pivot joint to the U shaped set 34 by pivot shaft.

The four stand columns 10 comprises two first stand columns and two second stand columns, the first stand columns are disposed at one side, the two second stand columns are disposed at the other side, the first stand columns and the second stand columns are symmetrically arranged along the axis; at this embodiment, two first stand columns and two second stand columns are arranges at four angels of a rectangle when in unfolding state.

The other ends of the second poles 32 connected to the first stand columns are pivot joint to a first top set 41, the non-end portions of the second poles 32 connected to the first stand columns 10 are respectively pivot joint to a first support rod 42. The ends of the first support rods 42 are pivot joint to a first bottom set 43; the other ends of the second poles 32 connected to the second stand columns 10 are pivot joint to a second top set 44, the non-end portions of the second poles 32 connected to the second stand columns 10 are respectively pivot joint to a second support rod 45. The ends of the second support rods 45 are pivot joint to the second bottom set 46; the first top set 41, the first bottom set 43, the second top set 44 and the second bottom set 46 are pivot joint to a second folding bracket, the second folding bracket comprises a scissor type second linkwork 47.

An awning with the awning mounting rack further comprises an awning cloth, the awning cloth is connected to the upper side of the second folding bracket and the top holder.

An awning top of the awning mounting rack comprises above top holder, first top set 41, first bottom set 43, second top set 44, second bottom set 46 and the second folding bracket.

The Second Embodiment

Figure 8:
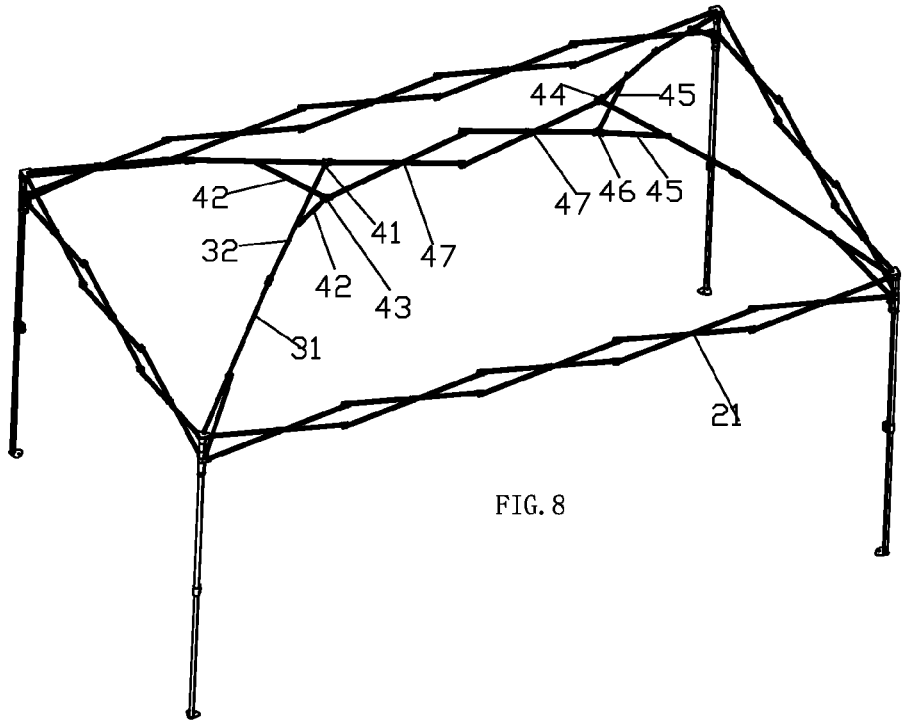
FIG. 8 illustrates a schematic diagram of an awning mounting rack of a second embodiment in unfolding state.
Figure 9:
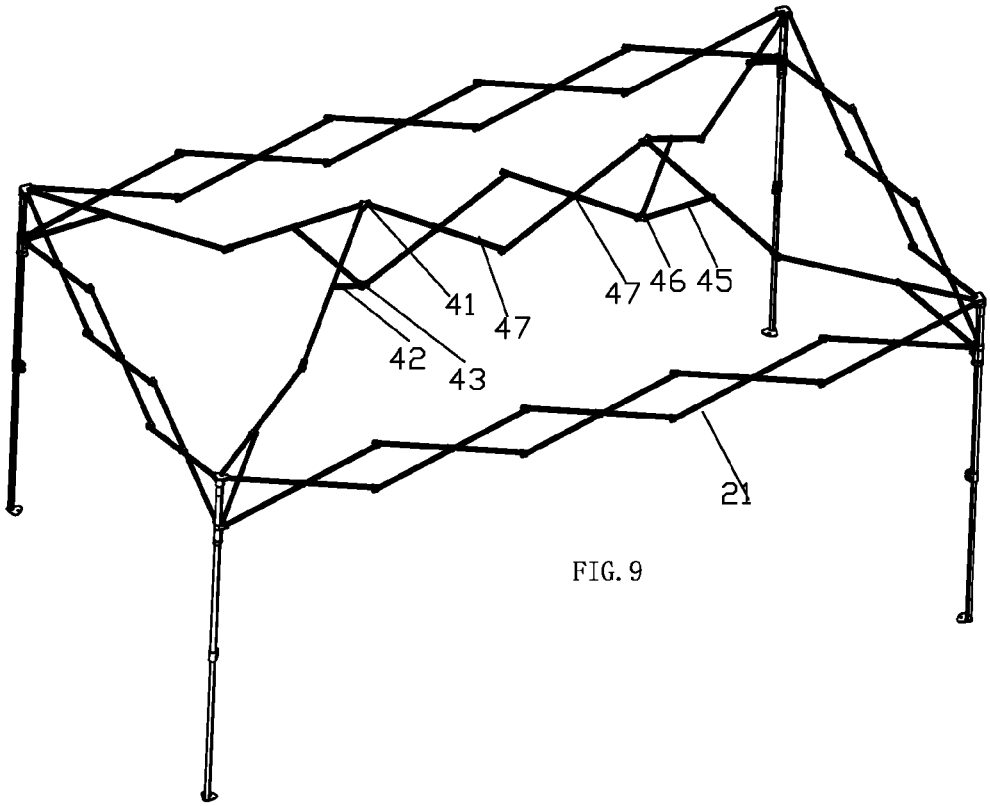
FIG. 9 illustrates a schematic diagram of the awning mounting rack of the second embodiment in semi-folding state.
Figure 10:
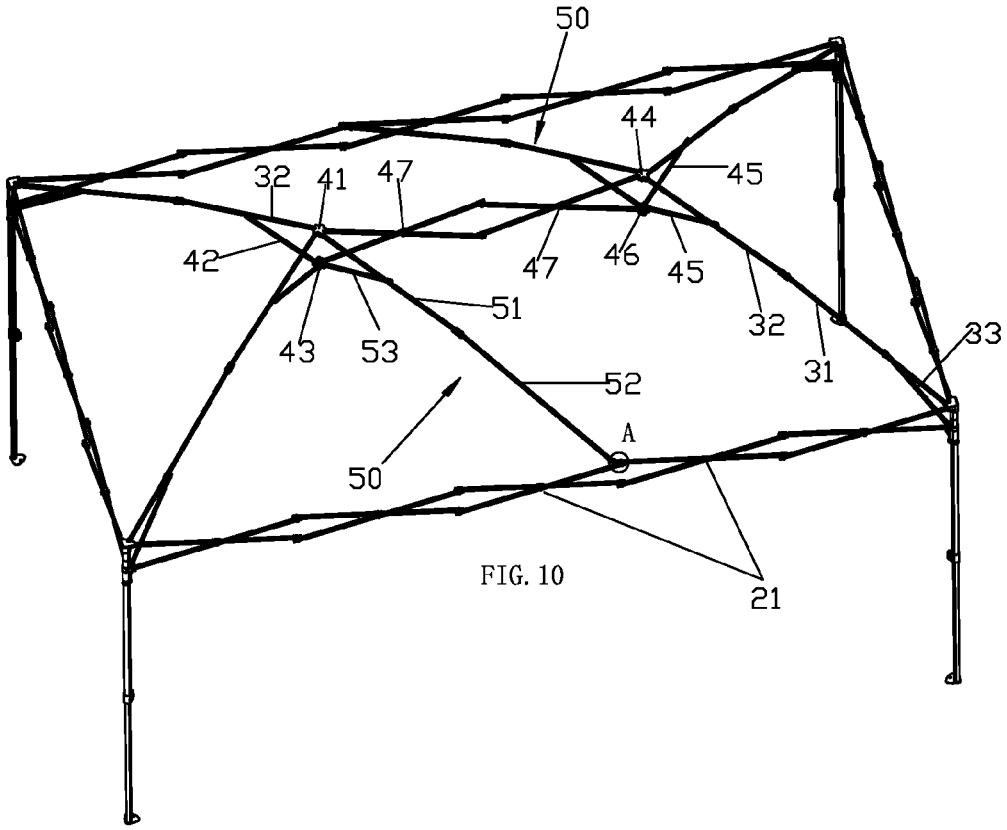
FIG. 10 illustrates a schematic diagram of an awning mounting rack of a third embodiment in unfolding state.
Figure 11:
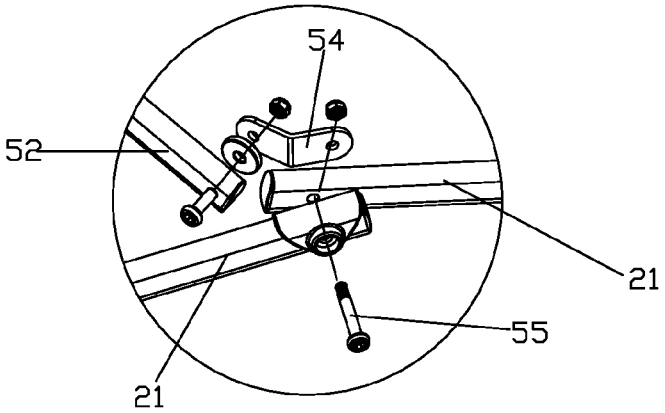
FIG. 11 illustrates an enlargement diagram of A in FIG. 10.
Figure 12:
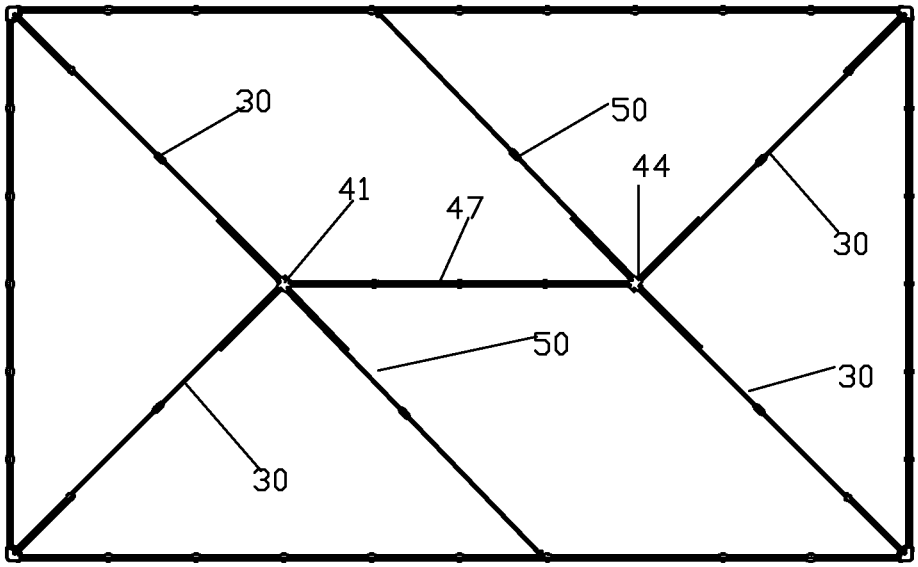
FIG. 12 illustrates a top view of the awning mounting rack of the third embodiment in unfolding state.
Figure 13:
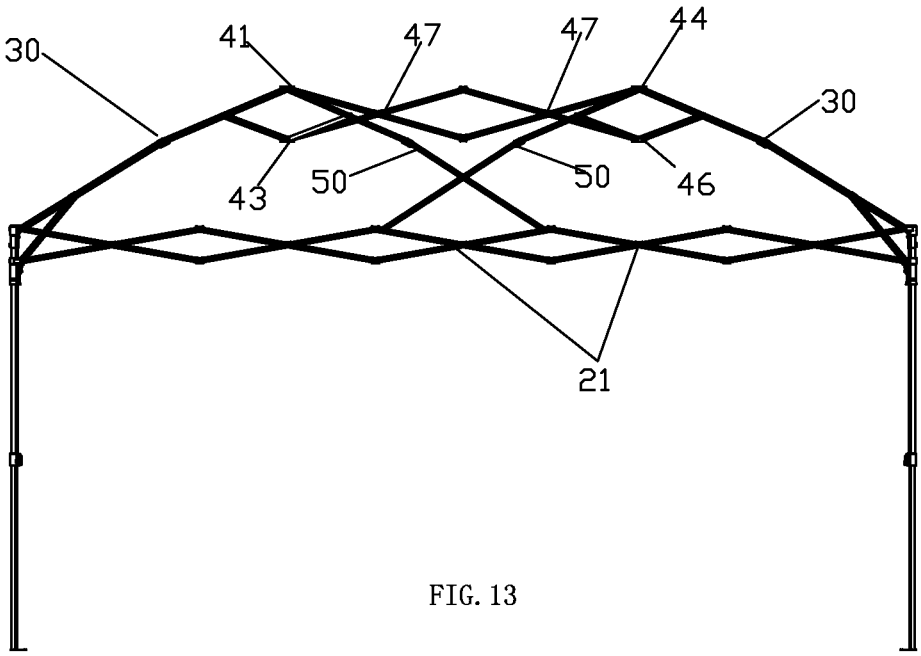
FIG. 13 illustrates a front view of the awning mounting rack of the third embodiment in unfolding state.
Figure 14:
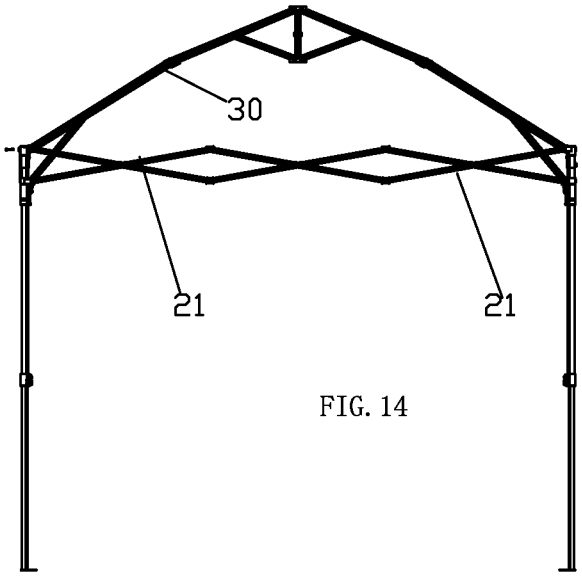
FIG. 14 illustrates a left side view of the awning mounting rack of the third embodiment in unfolding state.
Figure 15:
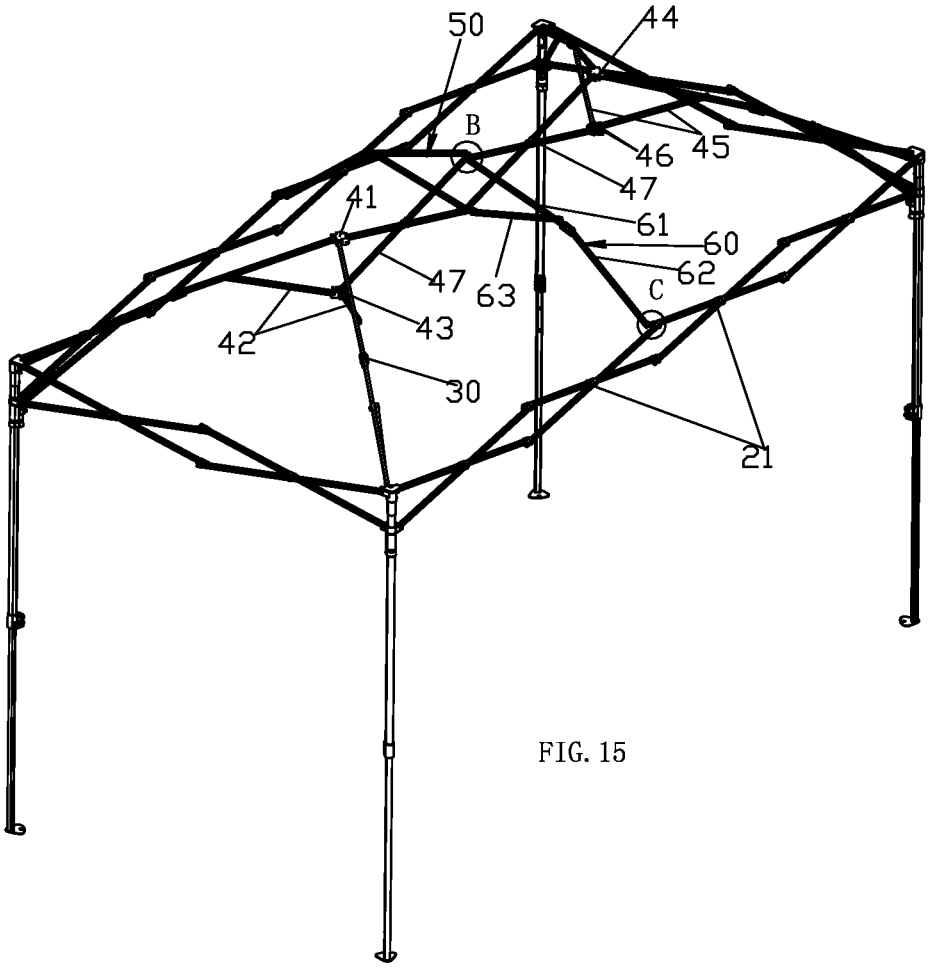
FIG. 15 illustrates a schematic diagram of an awning mounting rack of a fourth embodiment in unfolding state.
Figure 16:
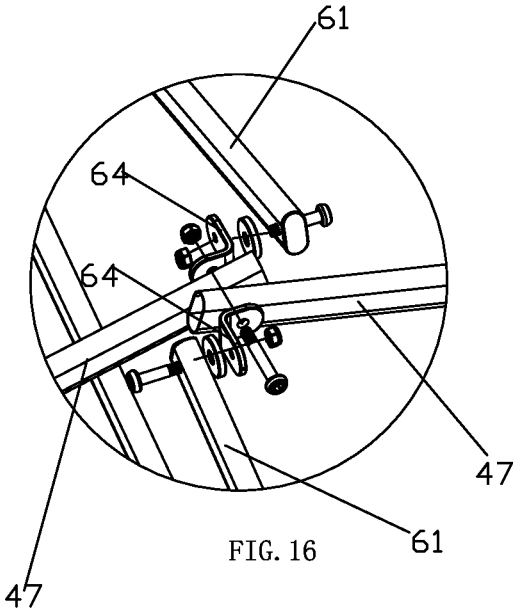
FIG. 16 illustrates an enlargement diagram of B in FIG. 15.
Figure 17:
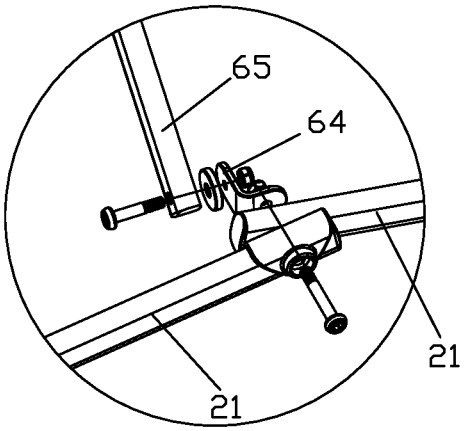
FIG. 17 illustrates an enlargement diagram of C in FIG. 15.
Figure 18:
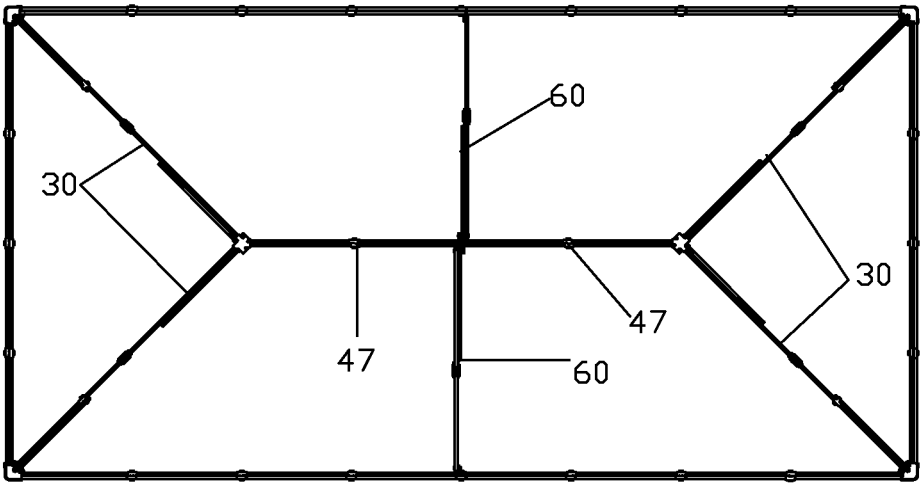
FIG. 18 illustrates a top view of the awning mounting rack of the fourth embodiment in unfolding state.
Figure 19:
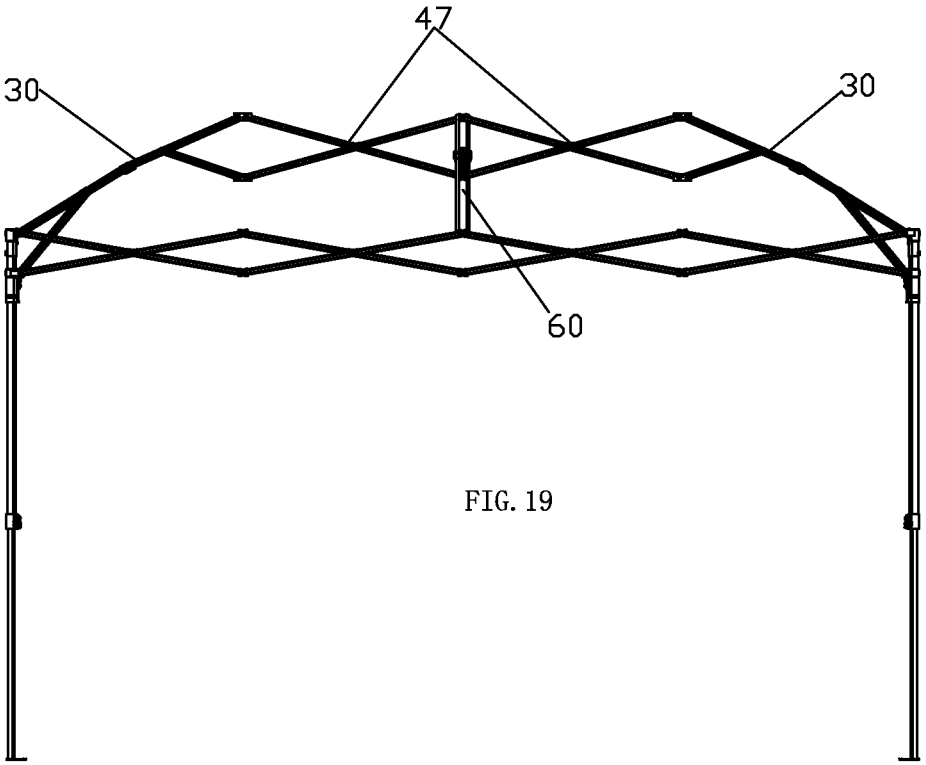
FIG. 19 illustrates a front view of the awning mounting rack of the fourth embodiment in unfolding state.
Figure 20:
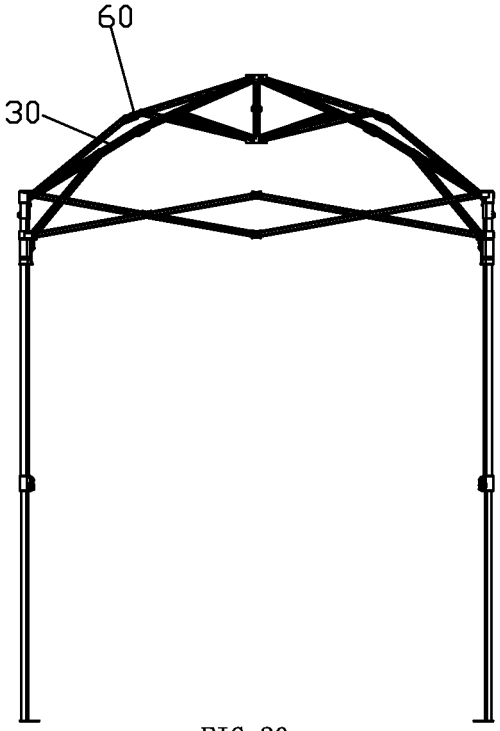
FIG. 20 illustrates a left side view of the awning mounting rack of the fourth embodiment in unfolding state.

The difference of the second embodiment from the first embodiment is that: referring to FIG. 8 and FIG. 9, the second folding bracket comprises two scissor type second linkworks 47 that are series connected. The series connecting means the same with above, in the second embodiment, there are two second linkworks 47.

The Third Embodiment

The difference of the third embodiment from the second embodiment is that: referring to FIGS. 10-14, the third embodiment further comprises a first reinforcing bracket 50, the first reinforcing bracket 50 comprises a first reinforcing pole 51, a second reinforcing pole 52 and a first driving pole 53.

Two first linkworks 21 of the first folding bracket 20 are series connected and pivoted, they have an upper pivot position and a second pivot position, the upper pivot position is a position that the upper ends of the link rods of two adjacent first linkworks are pivot joint together; the lower pivot position is a position that the lower ends of the link rods of two adjacent first linkworks are pivot joint together. One end of the first reinforcing pole 51 is rotatably connected to one end of the second reinforcing pole 52, the other end of the first reinforcing pole 51 is pivot joint to the first top set 41, the other end of the second reinforcing pole 52 is pivot joint to an upper pivot position, both ends of the first driving pole 53 are respectively pivot joint to the first bottom set 43 and the non-end portion of the first reinforcing pole 51. A first reinforcing bracket 50 is pivot joint to the second top set 44, the second bottom set 46 and the upper pivot position of the first folding bracket 20 that is faced to another first folding bracket 20 that is connected to the first reinforcing bracket 50.

In this embodiment, the first folding bracket 20 connecting the first stand column and the second stand column comprises five first linkworks 21, the five first linkworks 21 have four upper pivot position and four lower pivot position. The other end of the second reinforcing pole 52 corresponding to the first stand column is pivot joint to a third upper pivot position of the first folding bracket connecting the first stand column and the second stand column at the position that is between the first stand column and the second stand column; the other end of the second reinforcing pole 52 corresponding to the second stand column is pivot joint to another a third upper pivot position of the first folding bracket connecting the first stand column and the second stand column at the position that is between the first stand column and the second stand column. The two first reinforcing brackets 50 are parallel arranged.

In another preferred embodiment, the upper pivot position is that: in two adjacent first linkworks, the upper end of one link rod of the first linkwork is disposed with a throughout hole, the upper end of the other link rod of the first linkwork is also disposed with a throughout hole, it further comprises an L shaped set 54 and a pivot shaft 55, the L shaped set comprises first plate and a second plate that is fixedly connected to one side of the first plate, the first plate is disposed with a throughout hole, the link rod of the first linkwork, the link rod of the second linkwork and the first plate of the L shaped set are arranged side by side to align the three throughout holes, the pivot shaft runs through the three throughout holes and connects these three together, the other end of the second reinforcing pole is pivot joint to the second plate of the L shaped set. In other case, it can applied with the pivot shaft without configuring the upper pivot position of the second reinforcing pole.

The Fourth Embodiment

The difference of the fourth embodiment from the second embodiment is that: referring to FIGS. 15-20, it further comprises a second reinforcing bracket 60, the second reinforcing bracket 60 comprises a third reinforcing pole 61, a fourth reinforcing pole 62 and a second driving pole 63.

Two first linkworks 21 of the first folding bracket 21 are series connected and have a first upper pivot position and a first lower pivot position; two second linkworks 47 of the second folding bracket are series connected and have a second upper pivot position and a second lower pivot position.

One end of the third reinforcing pole 61 is rotatably connected to one end of the fourth reinforcing pole 62, the other end of the third reinforcing pole 61 and one end of the second driving pole 63 are respectively pivot joint to the corresponding second upper pivot position and second lower pivot position, the other end of the fourth reinforcing pole 62 is pivot joint to a first upper pivot position, the other end of the second driving pole 63 is pivot joint to the non-end portion of the third reinforcing pole 61.

In this embodiment, the second folding bracket comprises two first linkworks, the second folding bracket comprises a second upper pivot position and a second lower pivot position; the first folding bracket 20 connected to the first stand column and the second stand column comprises four first linkworks 21, the four first linkworks 21 has three upper pivot positions and three low pivot positions.

In this embodiment, it comprises two second reinforcing brackets 60, the other ends of the fourth reinforcing poles 62 of the two second reinforcing brackets 60 are respectively pivot joint to the first upper pivot positions at the centers of the two first folding brackets connected to the first stand column and the second stand column, two second reinforcing brackets 60 are coaxially and symmetrically arranged.

The first upper pivot position, the second upper pivot position, the second lower pivot position are disposed to an L shaped set 64, the L shaped set 64 has similar structure with the L shaped set in the third embodiment.

The Fifth Embodiment

Figure 21:
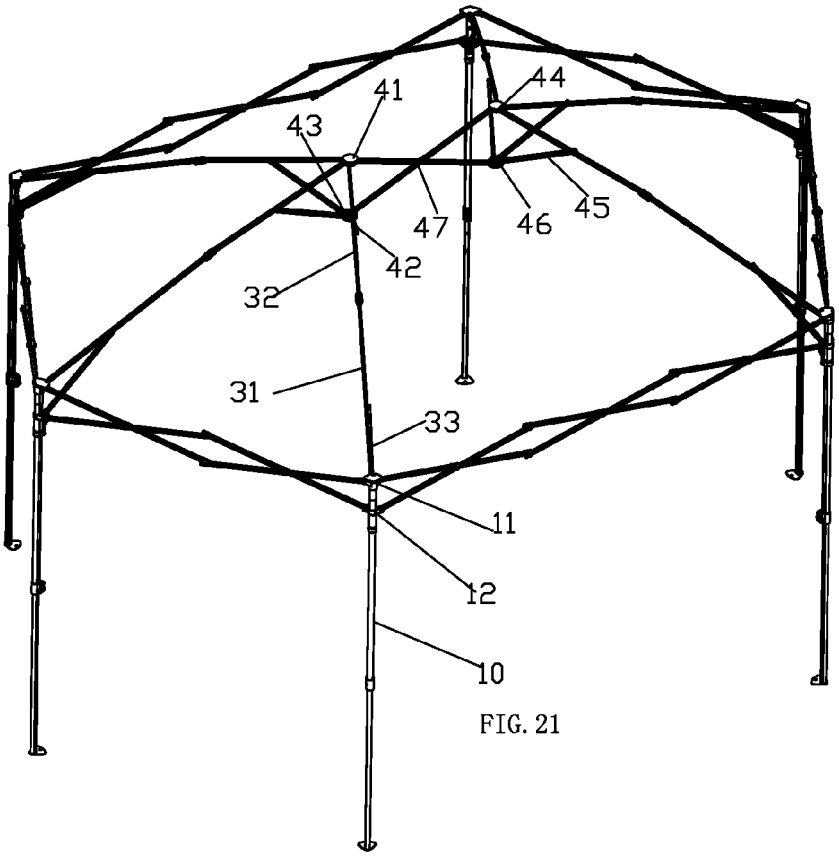
FIG. 21 illustrates a schematic diagram of an awning mounting rack of a fifth embodiment in unfolding state.
Figure 22:
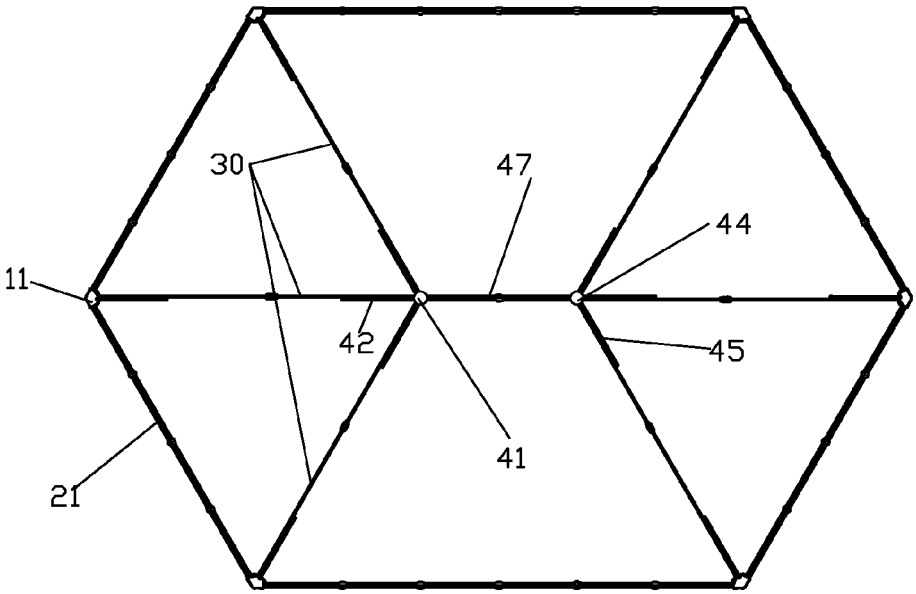
FIG. 22 illustrates a top view of the awning mounting rack of the fifth embodiment in unfolding state.

The difference of the fifth embodiment from the first embodiment is that: referring to FIG. 21 and FIG. 22, there are six stand columns 10: three first stand columns and three second stand columns, they are arranged to a hexagon structure.

Although the present invention has been described with reference to the preferred embodiments thereof for carrying out the patent for invention, it is apparent to those skilled in the art that a variety of modifications and changes may be made without departing from the scope of the patent for invention which is intended to be defined by the appended claims.

The invention claimed is:

1. An awning mounting rack, comprising:

a plurality of stand columns for standing on a ground surface, a top end of each stand column having a fixation set that is fixed at the top end of the stand column, each stand column including a slide set configured to slide along the stand column between the top end and a bottom end;

a plurality of first folding brackets, each first folding bracket connected between fixation sets of two adjacent stand columns and between slide sets of the two adjacent stand columns;

a plurality of top holders, each top holder having one end pivotably connected to a separate one of the fixation sets of a separate one of the plurality of stand columns, and each top holder having another end connected to one of a plurality of top sets;

a second folding bracket connected to the plurality of top holders; and a plurality of support rods connected between the second folding bracket and a non-end portion of the plurality of top holders, wherein each top holder comprises a first pole having a first end and a second end, a second pole having a third end and a fourth end, and a support pole having a fifth end and a sixth end, the first end of the first pole is pivotably connected to one of the fixation sets, the second end of the first pole is pivotably connected to the third end of the second pole, the fourth end of the second pole of two of the plurality of top holders is connected to a first top set among the plurality of top sets, and the fourth end of the second pole of two other top holders among the plurality of top holders is connected to a second top set among the plurality of top sets, the fifth end of the support pole is pivotably connected to the slide set of one of the plurality of stand columns, the sixth end of the support pole is pivotably connected to a portion of the first pole between the first end and the second end, the second folding bracket includes a plurality of poles pivotably connected to each other at a non-end portion of the plurality of poles to form a scissor-type linkworks, the second folding bracket including a first pole end, a second pole end, a third pole end, and a fourth pole end, the first pole end rotatably connected to the first top set, and the second pole end rotatably connected to the second top set, the plurality of support rods includes two first support rods, each having one end pivotably connected to a first bottom set connected to the third pole end of the second folding bracket and another end connected to a non-end portion of the second pole of first and second top holders among the plurality of top holders, the plurality of support rods includes two second support rods, each having one end pivotably connected to a second bottom set connected to the fourth pole end of the second folding bracket and another end connected to a non-end portion of third and fourth top holders among the plurality of top holders.

2. The awning mounting rack according to claim 1, wherein the first folding bracket comprises two scissor: type first linkworks that are series connected, and a lock device is disposed between each slide set and a respective stand column for locking and unlocking a sliding action of the slide set along the respective stand column.

3. The awning mounting rack according to claim 2, further comprising a first reinforcing bracket that comprises a first reinforcing pole, a second reinforcing pole and a first driving pole, wherein the two first linkworks of the first folding bracket are pivotally series connected and comprise an upper pivot joint and a lower pivot joint;

one end of the first reinforcing pole is rotatably connected to one end of the second reinforcing pole, the other end of the first reinforcing pole pivotably connected to the first top set, the other end of the second reinforcing pole is pivotably connected to the upper pivot position joint, and both ends of the first driving pole are respectively pivotably connected to the first bottom set and a non-end portion of the first reinforcing pole.

4. The awning mounting rack according to claim 3, wherein a first reinforcing bracket is pivotably connected to each of the second top set, the second bottom set and the upper pivot joint of the first folding bracket.

5. An awning comprising the awning mounting rack according to claim 2, further comprising an awning cloth, wherein the awning cloth is connected to the top side of the second folding bracket and the top holder.

6. The awning mounting rack according to claim 1, wherein the first folding mounting bracket comprises two scissor-type first linkworks that are pivotally series connected, the second folding bracket comprises two scissor-type second linkworks that are pivotally series connected, and a lock device is disposed between the slide set and a respective stand column for locking and unlocking a sliding action of the slide set along the respective stand column.

7. The awning mounting rack according to claim 6, further comprising:

a second reinforcing bracket that comprises a third reinforcing pole, a fourth reinforcing pole and a second driving pole;

the two first linkworks of the first folding bracket are pivotally series connected and comprise a first upper pivot joint and a first lower pivot joint;

the two second linkworks of the second folding bracket are pivotally series connected and comprise a second upper pivot joint and a second lower pivot joint;

one end of the third reinforcing pole is rotatably connected to one end of the fourth reinforcing pole, the other end of the second reinforcing pole is pivotably connected to the second upper pivot joint, the other end of the fourth reinforcing pole is pivotably connected to the first upper pivot joint, both ends of the second driving pole are respectively pivoted pivotably connected to the second lower pivot joint and a non-end portion of the third reinforcing pole.

8. The awning mounting rack according to claim 6, further comprising a first reinforcing bracket that comprises a first reinforcing pole, a second reinforcing pole and a first driving pole, wherein the two first linkworks of the first folding bracket are pivotally series connected and comprise an upper pivot joint and a lower pivot joint, one end of the first reinforcing pole is rotatably connected to one end of the second reinforcing pole, the other end of the first reinforcing pole is pivotably connected to the first top set, the other end of the second reinforcing pole is pivotably connected to the upper pivot joint, and both ends of the first driving pole are respectively pivotably connected to the first bottom set and a non-end portion of the first reinforcing pole.

9. The awning mounting rack according to claim 8, wherein a first reinforcing bracket is pivotably connected to each of the second top set, the second bottom set, and the upper pivot joint of the first folding bracket.

10. An awning comprising the awning mounting rack according to claim 6, further comprising an awning cloth, wherein the awning cloth is connected to the top side of the second folding bracket and the top holder.

11. The awning mounting rack according to claim 1, wherein the number of the plurality of stand columns is an even number, the plurality of stand columns includes a plurality of first stand columns and a plurality of second stand columns, the first stand columns are equal in number to the second stand columns, and the first stand columns and the second stand columns are coaxially and symmetrically arranged.

12. An awning comprising the awning mounting rack according to claim 1, further comprising an awning cloth, wherein the awning cloth is connected to the top side of the second folding bracket and the top holder.

13. An awning top of an awning mounting rack, comprising:

four top supports, the top supports comprise a first pole having a first end and a second end, a second pole having a third end and a fourth end, and a support pole, the first end of the first pole pivotably connected to a stand column for standing on a ground surface, the second end of the first pole being rotatably connected to the third end of the second pole, one end of the support pole pivotably connected to a non-end portion of the first pole, and the other end of the support pole being slideably connected to the stand column, wherein the four top supports comprise two first top supports and two second top supports;

a first top set to which the fourth ends of the second poles of the two first top supports are pivotably connected;

two first support rods, each having one end pivotably connected to a respective one of non-end portions of the second poles of the two first top supports;

a first bottom set to which the other end of each first support rod is pivotably connected;

a second top set to which the fourth end of each of second pole of the two second top supports is pivotably connected;

two second support rods each having one end pivotably connected to a respective one of a non-end portion of the second poles of the two second top supports;

a second bottom set to which the other end of each second support rod is pivotably connected; and a second folding bracket pivotably connected to the first top set, the first bottom set, the second top set and the second bottom set.

* * * * *